US006755164B2

(12) United States Patent
Park

(10) Patent No.: US 6,755,164 B2
(45) Date of Patent: Jun. 29, 2004

(54) VARIABLE VALVE TIMING APPARATUS FOR VEHICLE ENGINE

(75) Inventor: Chee-Hoon Park, Kyungki-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/092,824

(22) Filed: Mar. 6, 2002

(65) Prior Publication Data

US 2002/0195073 A1 Dec. 26, 2002

(30) Foreign Application Priority Data

Jun. 20, 2001 (KR) ..... 2001-34957

(51) Int. Cl.[7] ..... F01L 1/34

(52) U.S. Cl. ..... 123/90.17; 74/568 R; 123/90.15; 464/1

(58) Field of Search ..... 123/90.17, 90.15, 123/90.16; 74/568 R; 464/1, 2, 160; 92/67, 68

(56) References Cited

U.S. PATENT DOCUMENTS 3,217,607 A * 11/1965 Bitzer ..... 91/178
3,434,387 A * 3/1969 Ellis ..... 91/1
5,049,039 A * 9/1991 Knoth et al. ..... 417/273
5,117,785 A * 6/1992 Suga et al. ..... 123/90.17
5,179,918 A 1/1993 Gyurovits
5,195,471 A 3/1993 Hara
5,440,969 A * 8/1995 Shin ..... 92/68
5,826,552 A 10/1998 Noguchi et al.
5,832,887 A 11/1998 Adachi et al.
5,865,151 A 2/1999 Fukaya et al.
5,870,983 A 2/1999 Sato et al.
6,058,897 A * 5/2000 Nakayoshi ..... 123/90.17
6,332,439 B2 * 12/2001 Sekiya et al. ..... 123/90.17

FOREIGN PATENT DOCUMENTS

JP WO 01/34947 A1 10/1999

* cited by examiner

*Primary Examiner*—Thomas Denion
*Assistant Examiner*—Jaime Corrigan
(74) *Attorney, Agent, or Firm*—Morgan Lewis & Bockius LLP

(57) ABSTRACT

A variable valve timing apparatus for vehicle engine, the apparatus comprising: a rotor secured at a tip end of a cam shaft; a housing with the rotor rotatably mounted therein; and a piston mounted in the housing for rotating the rotor, such that the number of oil pressure chambers and seals is reduced to improve tightness of the oil pressure chambers and friction area is also reduced to decrease the consumed driving oil pressure.

7 Claims, 3 Drawing Sheets

VARIABLE VALVE TIMING APPARATUS FOR VEHICLE ENGINE

FIELD OF THE INVENTION

The present invention relates to a variable valve timing apparatus for a vehicle engine, and more particularly to a variable valve timing apparatus for a vehicle engine adapted to reduce the number of oil chambers and seals for maintaining tightness in the oil chambers, and to reduce driving oil pressure.

BACKGROUND OF THE INVENTION

Generally, engines can generate high output when the exchange action between the combustion gas and fuel-air mixture in the combustion chamber; that is, the infusion of fuel-air mixture and exhaust action of the combustion gas, is fully and swiftly effected. However, because the infused fuel-air mixture and discharged combustion gas each have a kinetic inertia, suction and discharge actions of fuel-air mixture and combustion gas cannot be optimally controlled in situations where the relative operation state of intake/exhaust valves is constantly fixed.

As a result of the above, modem-day vehicles variably control the valve timing to maintain an optimal suction/exhaust state such that operational efficiency of engine over an entire range can be improved. The variable valve timing apparatus for variably controlling a valve timing thus described is generally divided into a helical spline type and a vane type. The variable apparatus of the helical spline type has a disadvantage in that manufacturing cost is high due to use of helical gears and much oil is consumed for driving thereof. Thus, the recent tendency is that the use of the variable apparatus of the vane type is on the increase.

FIGS. 1 and 2 respectively illustrate an installed example of a variable valve timing apparatus of the vane type and a sectional view thereof. The variable apparatus 100 is comprised of a rotor 102 secured at a tip end of cam shaft 101 and formed at a peripheral surface thereof with a plurality of vanes 103, and a housing 105 having the built-in rotor 102 and formed at a peripheral surface thereof with a driving gear 106. Furthermore, the housing 105 is formed therein with a plurality of protruders 107, while the vane 103 is mounted with a seal 104 for contracting an inner circumferential surface of the housing 105, and oil chambers 108 and 109 are formed on both sides of the vane 103. Oil infused into the two oil chambers 108 and 109 through an oil control valve is controlled to adjust phases of vanes 103 relative to the housing 105, thereby adjusting phases of cam shaft 101 connected to the rotor 102, by which opening and closing time of the valve can be variably controlled.

However, there is a problem in the variable valve timing apparatus thus described in that a rotor usually formed with 3–4 vanes is used (although there are some variations according to products) and, as a result, the number of oil chambers formed at the housing is increased. Also the number of seals for maintaining airtightness of the oil chambers is increased such that the augmented number of seals gives rise to increase of contact surface between the rotor and the housing, resulting in subsequent gain in needed driving oil pressure.

SUMMARY OF THE INVENTION

The present invention provides a variable valve timing apparatus for a vehicle engine constructed to reduce the number of oil chambers and seals and to decrease the needed driving oil pressure.

In accordance with a preferred embodiment of the present invention, a variable valve timing apparatus for vehicle engine comprises, a rotor secured at a tip end of a cam shaft, a housing with the rotor rotatably mounted therein, and a piston mounted in the housing for rotating the rotor. The rotor is formed with two vanes, the vanes being positioned within rotary spaces formed at the housing. Oil pressure chambers are formed at a housing body between the rotary spaces, where the oil pressure chambers are inherently mounted with the pistons. Each piston is connected via a rod to the vane located in opposition thereto.

According to a further alternative embodiment of the invention, a timing apparatus for an engine cam shaft comprises a rotor, a housing, a piston and rod, and a timing gear. The rotor is mounted on the cam shaft. The housing surrounds the rotor and defines at least one oil chamber. The piston is disposed in the chamber, with the rod linked to the rotor. The timing gear is mounted with the housing and preferably may be formed integrally therewith around the periphery. Oil pressure in the chamber may be varied to rotate the rotor with respect to the housing, thereby changing the phase of the cam shaft timing. Preferably, the rotor includes at least two opposed vanes and the housing defines at least two oil chambers serving as pressure cylinders communicating with an oil pressure control. Each cylinder then includes a piston linked to a vane of the rotor.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Now, preferred embodiment of the present invention will be described in detail with reference to the accompanying drawings.

Figure 1:
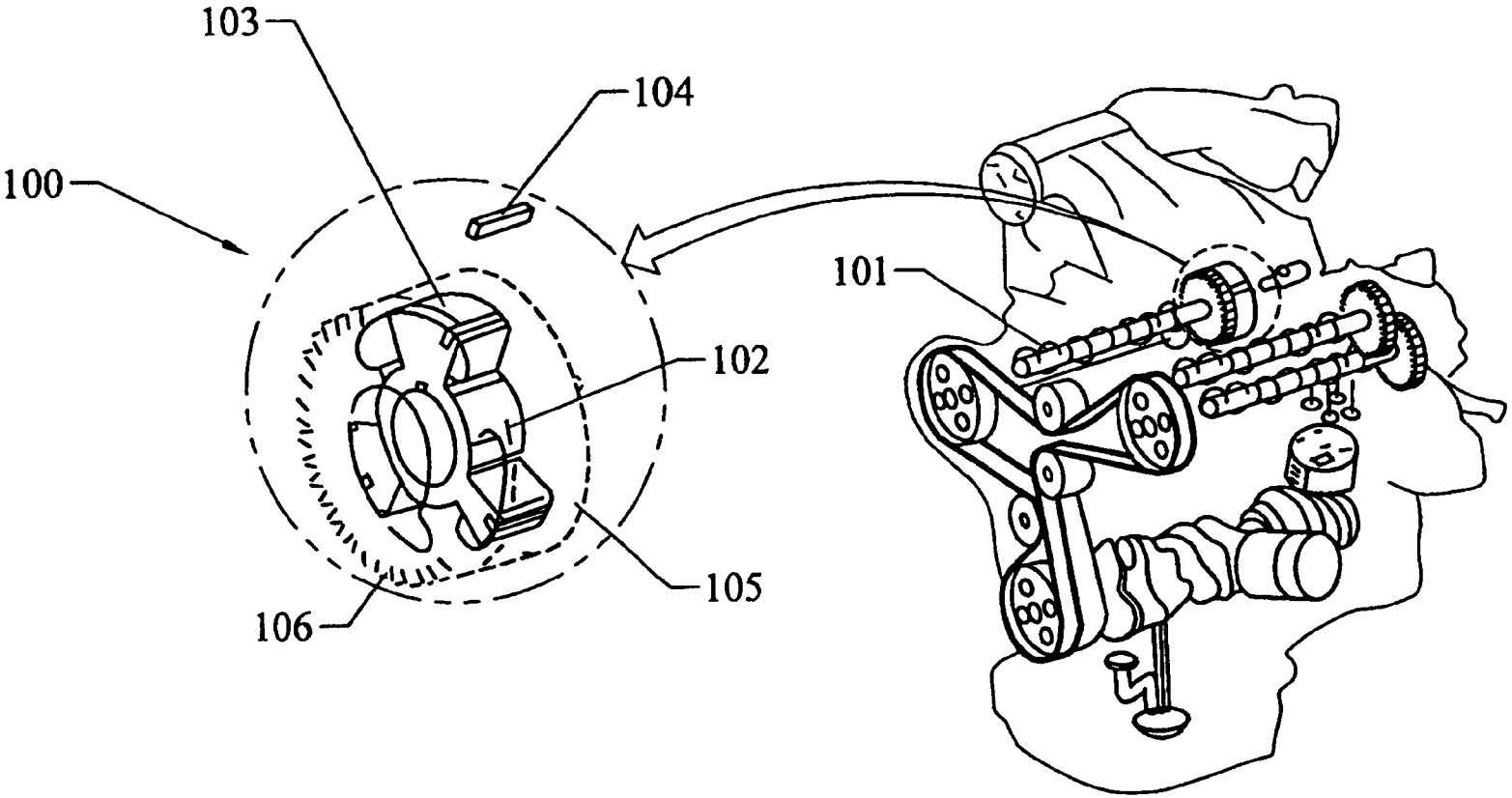
FIG. 1 (Prior Art)
FIG. 1 is a schematic view illustrating an installed state of vane-type variable valve timing apparatus according to the prior art.
Figure 2:
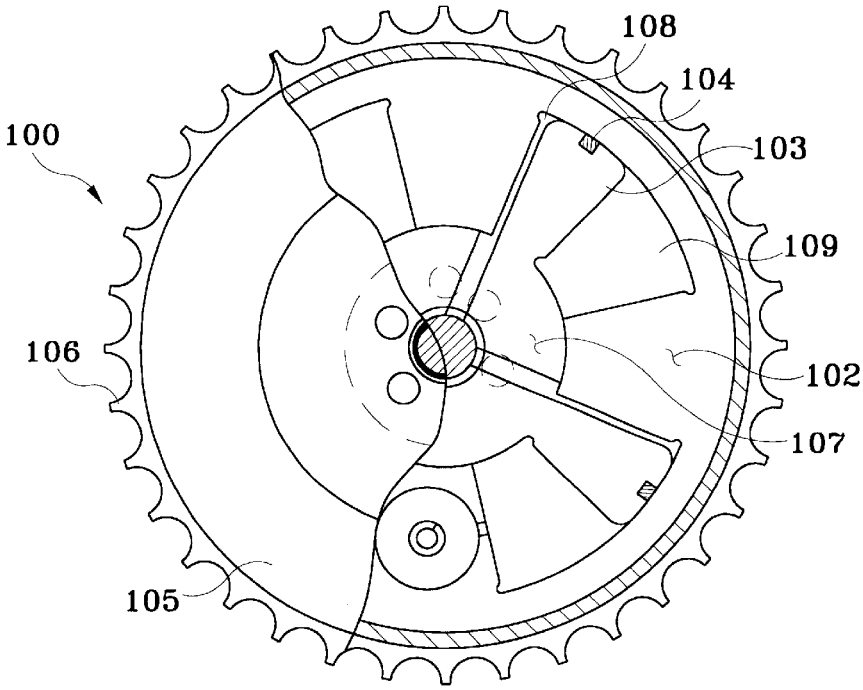
FIG.2 (Prior art)
FIG. 2 is a sectional view illustrating a vane-type variable valve timing apparatus according to the prior art.
Figure 3:
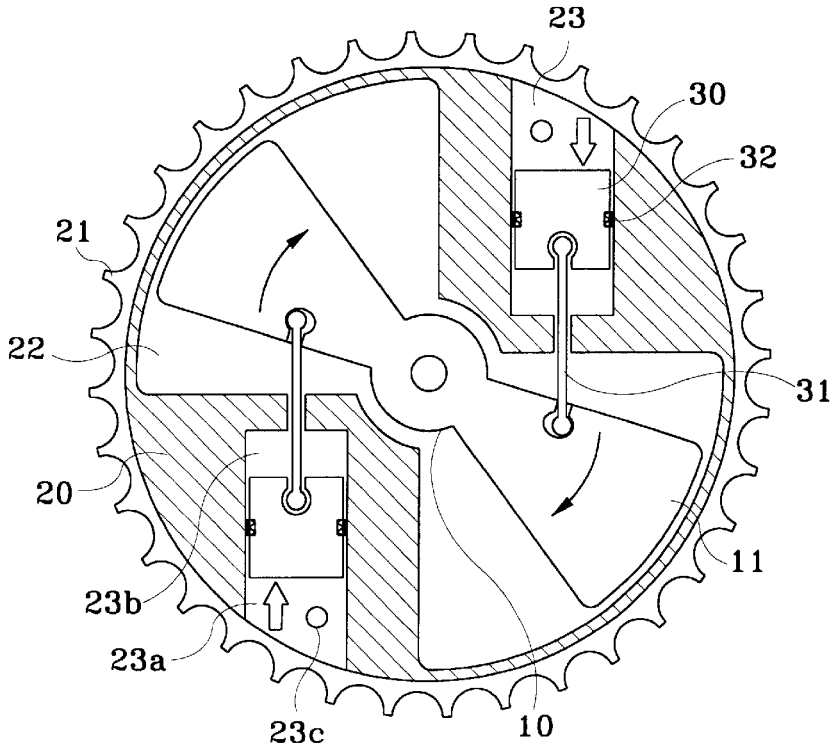
FIG. 3 is a sectional view illustrating a variable valve timing apparatus at an advanced angle according to the present invention.

Referring to FIG. 3, the present invention includes a rotor 10 secured at a tip end of a cam shaft via fastening means such as a bolt for rotating on the same phase as that of the cam shaft, a housing 20 with the rotor 10 rotatably mounted therein and formed at a circumferential surface thereof with a driving gear 21 for communicably moving the counterpart cam shaft via chain or driving belt, and a piston 30 mounted in the housing 20 for rotating the rotor 10.

The rotor 10 includes a fan-shaped vane 11 having tapering widths at both sides about a central portion where a cam shaft is secured, while the housing 20 is provided with a rotary space 22 in which the vane 11 can rotate. Housing 20 is formed with oil pressure chambers 23, each chamber 23 being equipped with the piston 30, and each rod 31 at the piston 30 being connected to the vane 11 positioned at facing rotary space 22. The piston 30 is centrally mounted with seals 32 by which the oil pressure chamber 23 is divided into advanced angle oil pressure chambers 23*a* and delayed angle oil pressure chambers 23*b*. Each advanced angle oil pressure chamber 23*a* and delayed angle oil pressure chamber 23*b* are formed with oil ports 23*c* and 23*d*.

Figure 4:
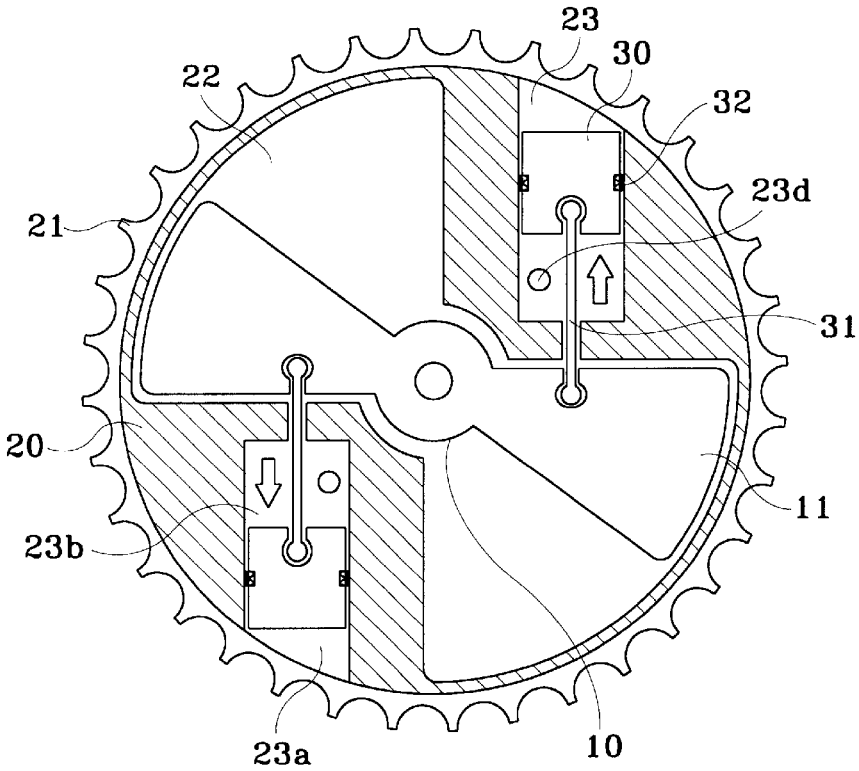
FIG. 4 is a sectional view illustrating a variable valve timing apparatus at a delayed angle according to the present invention.

When oil is supplied to the advanced angle oil pressure chamber 23*a* via the oil port 23*c* from a separately-equipped oil control valve, pistons 30 are moved into the oil pressure chambers 23 to cause the vane 11 to be rotated clockwise by the rod 31. Conversely, when oil subsides from the advanced angle oil pressure chamber 23*a* and oil is supplied to the delayed angle oil pressure chamber 23*b* via the oil port 23*d*, the pistons 30 are moved outside of the oil pressure chambers 23 to allow the vane 11 to rotate counterclockwise (see FIGS. 3 and 4).

As the pistons 30 are actuated by the oil supply to allow the vane 11 to rotate to both directions, there is generated a phase difference between the rotor 10 and the housing 20, thereby enabling to variably control the valve timing in advanced angle and delayed angle states.

Figure 5:
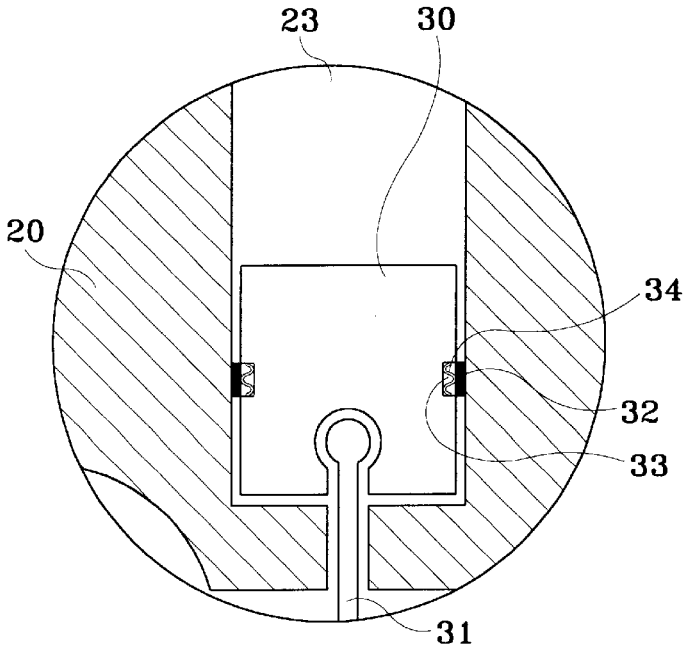
FIG. 5 is an enlarged sectional view of a piston at a variable valve timing apparatus according to the present invention.

In the variable valve timing apparatus thus described, only two oil pressure chambers are formed and only two seals are needed for dividing the advanced angle oil pressure chamber and the delayed angle oil pressure chamber, such that the number of oil pressure chambers and seals is reduced to decrease the area where the housing 20 is abraded, thereby curtailing necessary driving oil pressure. Also, as shown in FIG. 5, seal 32 is inserted into a groove 33 formed at a circumferential surface of the piston 30, where the groove 33 is mounted therein with a plate spring 34 which in turn pushes the seal 32 to the surface of the oil pressure chamber 23 for further improvement of tightness.

As apparent from the foregoing, there is an advantage in the variable valve timing apparatus for vehicle engine thus described according to the present invention in that the number of oil pressure chambers and seals is reduced to improve tightness of the oil pressure chambers and friction area is also reduced to decrease the consumed driving oil pressure.

What is claimed is:

1. A variable vane timing apparatus for vehicle engine, the apparatus comprising:

a rotor secured at a tip end of a cam shaft;

a housing with the rotor rotatably mounted therein, wherein the rotor comprises two vanes positioned within rotary spaces formed in the housing;

at least two oil pressure chambers formed between the rotary spaces; and a piston mounted within each of said pressure chambers in the housing for rotating the rotor with respect to the housing, where each piston is connected via a rod to one of said two vanes.

2. The apparatus as defined in claim 1, wherein the oil pressure chamber is divided by a seal mounted at the piston into an advanced angle oil pressure chamber and a delayed angle oil pressure chamber, the advanced angle oil pressure chamber and the delayed angle oil pressure chamber being formed with oil ports.

3. The apparatus as defined in claim 2, wherein the seal is pushed to an inner surface of the oil pressure chamber by a plate spring inserted into a groove at a circumferential surface of the piston.

4. A timing apparatus for an engine cam shaft, comprising:

a rotor mounted on the cam shaft;

a housing surrounding the rotor and defining at least one oil chamber;

a piston disposed in said chamber having a rod linked to said rotor; and a timing gear mounted with said housing, wherein oil pressure in said chamber may be varied to rotate the rotor with respect to the housing, thereby changing the phase of the cam shaft timing.

5. The apparatus of claim 4, wherein the timing gear is integrally formed around a periphery of said housing.

6. The apparatus of claim 4, wherein:

said rotor includes two opposed vanes; and said housing defines two oil chambers, each with a piston and rod linked to one said vane.

7. A timing apparatus for an engine cam shaft, comprising:

a rotor including at least two vanes mounted on the cam shaft;

a timing gear including a housing surrounding the rotor, said housing defining a space for receiving the rotor for rotary movement and at least first and second cylinder spaces, said cylinder spaces communicating with an oil pressure control;

a piston disposed in each said cylinder space; and an operative linkage between each said piston and a vane of said rotor, such that control of oil pressure in said cylinders may be may be varied to rotate the rotor with respect to the timing gear, thereby changing the phase of the cam shaft timing.

* * * * *